US007066405B2

(12) United States Patent
Wang

(10) Patent No.: US 7,066,405 B2
(45) Date of Patent: Jun. 27, 2006

(54) MODULAR MIST SPRAYER

(76) Inventor: Jun-Lin Wang, 58, Ma Yuan West St., Taichung (TW)

( * ) Notice: Subject to any disclaimer, the term of this patent is extended or adjusted under 35 U.S.C. 154(b) by 264 days.

(21) Appl. No.: 10/800,186

(22) Filed: Mar. 10, 2004

(65) Prior Publication Data

US 2005/0199750 A1 Sep. 15, 2005

(51) Int. Cl.
*B05B 9/03* (2006.01)

(52) U.S. Cl. ..... 239/302; 239/461; 239/498; 239/99; 239/22; 239/23; 239/318; 239/8; 239/337; 239/338; 239/343; 239/351; 239/373

(58) Field of Classification Search ..... 239/22, 239/23, 302, 311, 318, 136, 222.11, 498
See application file for complete search history.

(56) References Cited

U.S. PATENT DOCUMENTS 685,110 A * 10/1901 Crouch ..... 239/18
3,151,811 A * 10/1964 Hruby, Jr. ..... 239/20
6,257,560 B1 * 7/2001 Kim ..... 261/36.1
6,681,508 B1 * 1/2004 Unger et al. ..... 40/406

FOREIGN PATENT DOCUMENTS

TW 395205 * 6/2000

* cited by examiner

*Primary Examiner*—David A. Scherbel
*Assistant Examiner*—James S. Hogan
(74) *Attorney, Agent, or Firm*—Alan D. Kamrath; Nikolai & Mersereau, P.A.

(57) ABSTRACT

A mist sprayer includes a base, a pump, a pressure storage member, a circuit board, a mounting tube, an injection unit, a decorative shade, a mounting seat, a guide unit, a bottle, and a plug. Thus, the liquid is mixed with and atomized by the pressurized gas and the misted gas hits the striking face of the guide unit to multiple misted molecules, thereby enhancing and optimizing the atomized effect of the liquid.

20 Claims, 3 Drawing Sheets

MODULAR MIST SPRAYER

BACKGROUND OF THE INVENTION

1. Field of the Invention

The present invention relates to a modular mist sprayer, and more particularly to a mist sprayer that enhances and optimizes the atomized effect of the liquid.

2. Description of the Related Art

A conventional mist sprayer in accordance with the prior art is disclosed in the Taiwanese Patent Publication No. 395205. However, the conventional mist sprayer usually has a fixed structure, so that the shape and configuration of the conventional mist sprayer cannot be varied and adjusted, thereby limiting the versatility of the mist sprayer. In addition, the atomized liquid is directly drained upward and outward, such that the atomized effect of the liquid is not sufficient.

SUMMARY OF THE INVENTION

The primary objective of the present invention is to provide a mist sprayer having a modularized structure, so that the shape and configuration of the mist sprayer can be varied and adjusted easily and conveniently, thereby enhancing the versatility of the mist sprayer.

Another objective of the present invention is to provide a mist sprayer, wherein the liquid is mixed with and atomized by the pressurized gas and the misted gas hits the striking face of the guide unit to multiple misted molecules, thereby enhancing and optimizing the atomized effect of the liquid.

A further objective of the present invention is to provide a mist sprayer, wherein the mounting seat has a plurality of guide channels, thereby enhancing the atomized effect of the liquid.

In accordance with the present invention, there is provided a mist sprayer, comprising:

a base;

a mounting tube mounted on of the base;

an injection unit mounted on the mounting tube;

a pressure storage member mounted in and communicating with the injection unit;

a mounting seat mounted on the injection unit and having an inside communicating with the injection unit;

a guide unit mounted on the mounting seat; and a bottle having a lower end mounted on the injection unit and having an inside communicating with the mounting seat.

Further benefits and advantages of the present invention will become apparent after a careful reading of the detailed description with appropriate reference to the accompanying drawings.

DETAILED DESCRIPTION OF THE INVENTION

Figures 1, 1A:
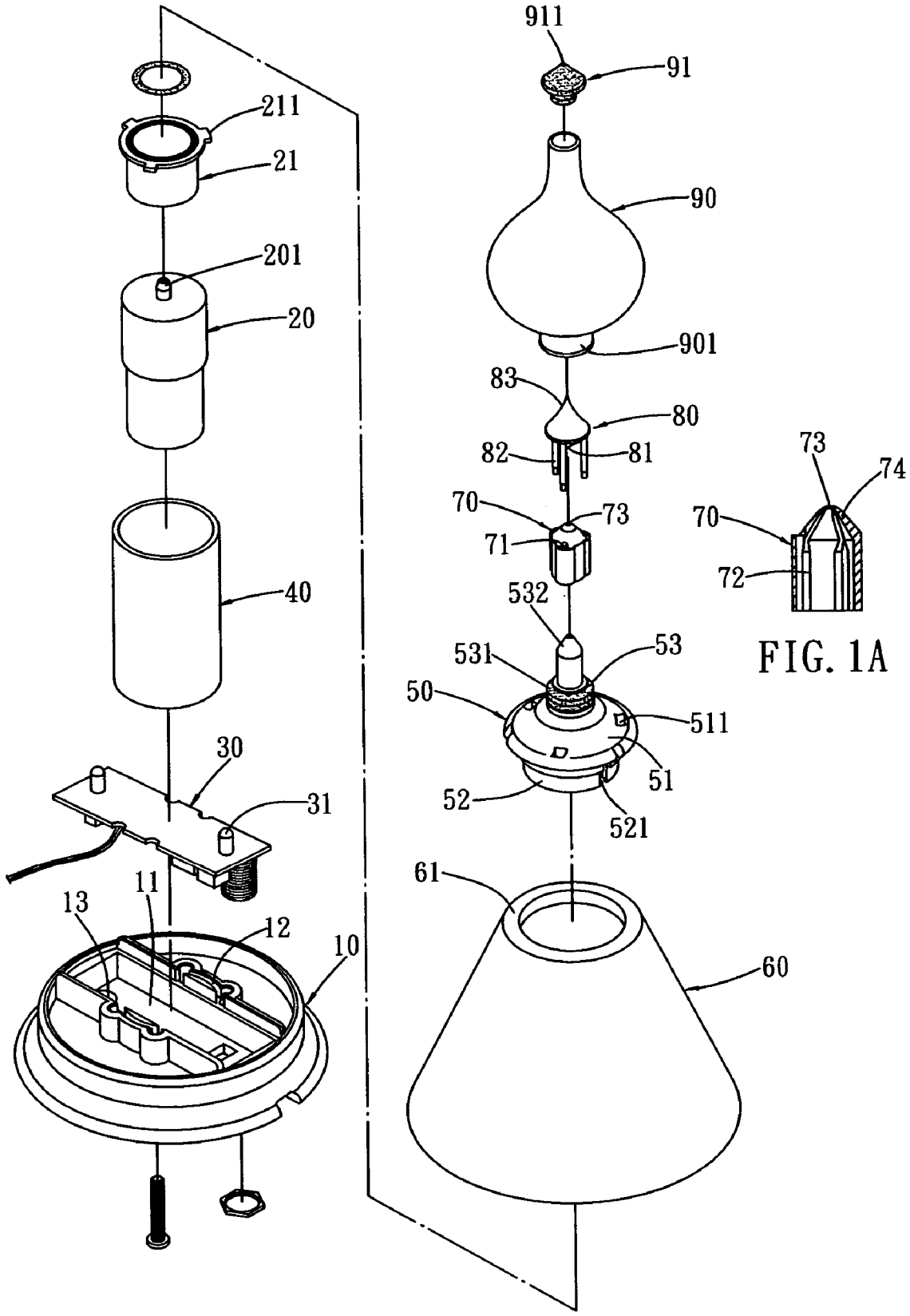
FIG. 1 is an exploded perspective view of a mist sprayer in accordance with the preferred embodiment of the present invention.
FIG. 1A is a plan cross-sectional enlarged view of a mounting seat of the mist sprayer as shown in FIG. 1.
Figures 2, 2A:
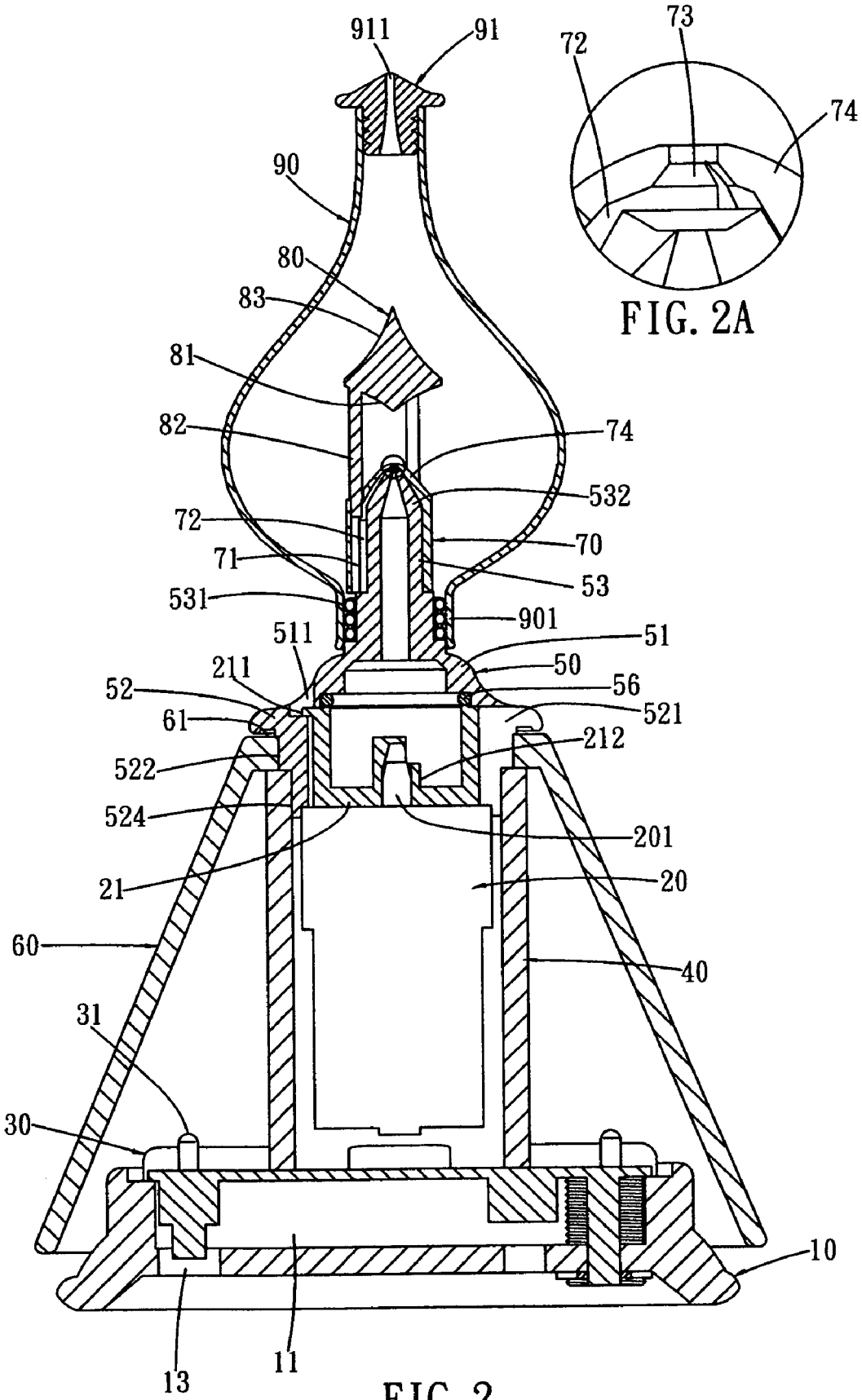
FIG. 2 is a plan cross-sectional assembly view of the mist sprayer as shown in FIG. 1.
FIG. 2A is a partially enlarged view of the mist sprayer as shown in FIG. 2.

Referring to the drawings and initially to FIGS. 1 and 2, a mist sprayer in accordance with the preferred embodiment of the present invention comprises a base 10, a pump 20, a pressure storage member 21, a circuit board 30, a mounting tube 40, an injection unit 50, a decorative shade 60, a mounting seat 70, a guide unit 80, a bottle 90, and a plug 91.

The base 10 has an inside formed with a receiving chamber 11 and provided with two opposite holders 12 each located beside the receiving chamber 11. The receiving chamber 11 of the base 10 has a bottom formed with a plurality of through holes 13.

The circuit board 30 is mounted in the receiving chamber 11 of the base 10 and is provided with a plurality of light emitting diodes (LED) 31.

The mounting tube 40 is mounted in the receiving chamber 11 of the base 10 and positioned by the two opposite holders 12 of the base 10. Preferably, the mounting tube 40 is rested on the circuit board 30.

The injection unit 50 includes a circular cover 51 mounted on the mounting tube 40, a nozzle 53 mounted on an upper end of the cover 51 and formed with a tapered head 532, a mounting section 52 mounted on a lower end of the cover 51 and rested on the mounting tube 40, and a plurality of sealing rings 531 mounted on the nozzle 53 and rested on the cover 51. Preferably, the mounting section 52 of the injection unit 50 has a stepped shape and has an enlarged edge 522 rested on a top of the mounting tube 40 and a reduced edge 524 secured in the mounting tube 40. In addition, the cover 51 of the injection unit 50 has a periphery formed with a plurality of locking slots 511 equally spaced from each other, and the mounting section 52 of the injection unit 50 has a periphery formed with a plurality of slits 521 equally spaced from each other, so that the mounting section 52 of the injection unit 50 is flexible. Preferably, each of the slits 521 of the mounting section 52 is extended into the cover 51 of the injection unit 50.

The pressure storage member 21 is a cylindrical body having a substantially U-shaped cross-section. The pressure storage member 21 is mounted in the cover 51 of the injection unit 50 and has a bottom formed with a socket 212 and has a top having a periphery formed with a plurality of locking blocks 211 each locked in a respective one of the locking slots 511 of the cover 51. The locking blocks 211 of the pressure storage member 21 are inserted into the locking slots 511 of the cover 51 by flexibility of the mounting section 52 provided by the slits 521. An O-ring 56 is mounted between an inner wall of the cover 51 of the injection unit 50 and the top of the pressure storage member 21.

The pump 20 is mounted in the mounting tube 40 and has a top provided with a mouth 201 inserted into the socket 212 of the pressure storage member 21 and a bottom in contact with the circuit board 30 which is used to control operation of the pump 20.

The decorative shade 60 is mounted between the mounting tube 40 and the injection unit 50 and has a top having an inner edge formed with a mounting flange 61 mounted on the enlarged edge 522 of the mounting section 52 and rested on the top of the mounting tube 40.

The mounting seat 70 is a hollow body. The mounting seat 70 is mounted on the nozzle 53 of the injection unit 50 and has a tapered upper portion 74 mounted on the tapered head 532 of the nozzle 53. The tapered upper portion 74 of the mounting seat 70 is formed with an aperture 73 (see FIG. 2A) communicating with the nozzle 53 of the injection unit 50. The mounting seat 70 has a periphery formed with a plurality of mounting holes 71 and has an inner wall formed with a plurality of guide channels 72 (see FIG. 1A) each communicating with the aperture 73 and each having a gradually reduced distal end.

The guide unit 80 is mounted on the mounting seat 70 and has a bottom formed with a conical striking face 81 facing the aperture 73 of the mounting seat 70 and a top formed with a pointed guide face 83. The guide unit 80 has a periphery formed with a plurality of inserts 82 each inserted into a respective one of the mounting holes 71 of the mounting seat 70.

The bottle 90 is mounted on the injection unit 50 and has an inside communicating with the guide channels 72 of the mounting seat 70. The bottle 90 has a lower end formed with a mounting portion 901 mounted on the nozzle 53 of the injection unit 50, and the sealing rings 531 are sealed between the nozzle 53 of the injection unit 50 and the bottle 90.

The plug 91 is mounted on an upper end of the bottle 90 and has an inside formed with a horn-shaped through hole 911 communicating with the bottle 90.

Figures 3, 3A:
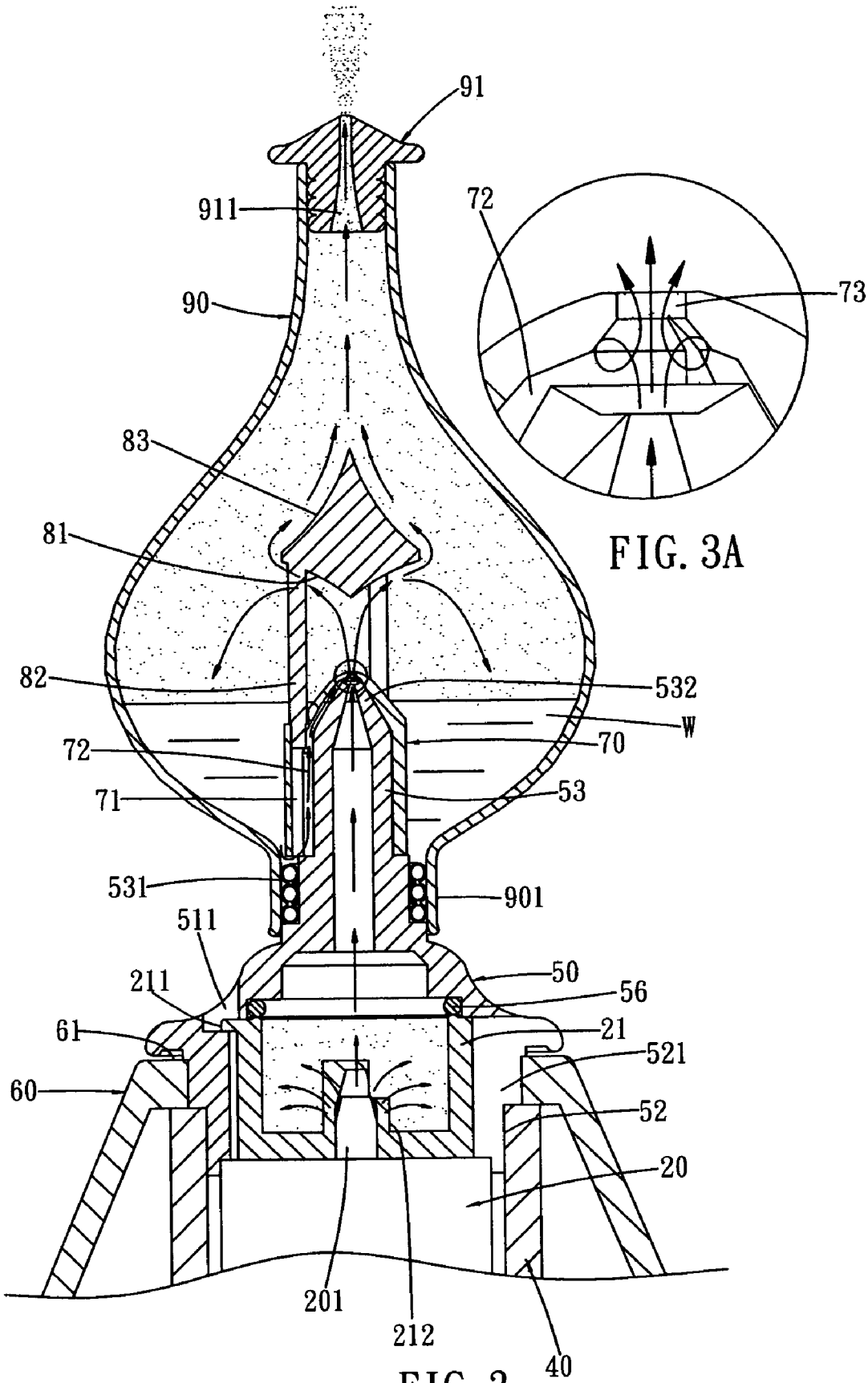
FIG. 3 is a schematic operational view of the mist sprayer as shown in FIG. 2 in use.
FIG. 3A is a partially enlarged view of the mist sprayer as shown in FIG. 3.

In operation, referring to FIGS. 3 and 3A with reference to FIGS. 1 and 2, a liquid "w" is poured into the bottle 90. Then, the pump 20 is operated by the circuit board 30 to inject a gas through the mouth 201 and the socket 212 into the pressure storage member 21 which is used to pressurize and store the gas. Then, the pressurized gas is ejected outward from the nozzle 53 of the injection unit 50 and is directed toward the aperture 73 of the mounting seat 70. At this time, the bottle 90 has an inside communicating with the guide channels 72 of the mounting seat 70 and each of the guide channels 72 communicates with the aperture 73, so that the liquid "w" in the bottle 90 is drawn through the guide channels 72 to the aperture 73 by action of the siphon principle. In such a manner, the liquid "w" is mixed with and atomized by the pressurized gas in the aperture 73 of the mounting seat 70 to form a misted gas. Then, the misted gas is pushed upward to hit the striking face 81 of the guide unit 80, thereby forming multiple misted molecules, wherein the smaller misted molecules are guided by the guide face 83 to move upward and the larger misted molecules directly fall onto the liquid "w" in the bottle 90, thereby forming a circulation effect. Finally, the smaller misted molecules are ejected outward from the through hole 911 of the plug 91.

Accordingly, the mist sprayer has a modularized structure, so that the shape and configuration of the mist sprayer can be varied and adjusted easily and conveniently, thereby enhancing the versatility of the mist sprayer. In addition, the liquid is mixed with and atomized by the pressurized gas and the misted gas hits the striking face 81 of the guide unit 80 to multiple misted molecules, thereby enhancing and optimizing the atomized effect of the liquid. Further, the mounting seat 70 has a plurality of guide channels 72, thereby enhancing the atomized effect of the liquid.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A mist sprayer, comprising:

a base;

a mounting tube mounted on of the base;

an injection unit mounted on the mounting tube;

a pressure storage member mounted in and communicating with the injection unit;

a mounting seat mounted on the injection unit and having an inside communicating with the injection unit;

a guide unit mounted on the mounting seat; and a bottle having a lower end mounted on the injection unit and having an inside communicating with the mounting seat.

2. The mist sprayer in accordance with claim 1, wherein the base has an inside formed with a receiving chamber and provided with two opposite holders each located beside the receiving chamber.

3. The mist sprayer in accordance with claim 2, further comprising a circuit board mounted in the receiving chamber of the base.

4. The mist sprayer in accordance with claim 3, further comprising a pump mounted in the mounting tube and having a top mounted to the pressure storage member and a bottom in contact with the circuit board which is used to control operation of the pump.

5. The mist sprayer in accordance with claim 4, wherein the pressure storage member has a bottom formed with a socket, and the top of the pump is provided with a mouth inserted into the socket of the pressure storage member.

6. The mist sprayer in accordance with claim 2, wherein the mounting tube is mounted in the receiving chamber of the base and positioned by the two opposite holders of the base.

7. The mist sprayer in accordance with claim 2, wherein the receiving chamber of the base has a bottom formed with a plurality of through holes.

8. The mist sprayer in accordance with claim 1, wherein the injection unit includes a cover mounted on the mounting tube, a nozzle mounted on an upper end of the cover and formed with a tapered head, and a mounting section mounted on a lower end of the cover and rested on the mounting tube.

9. The mist sprayer in accordance with claim 8, wherein the mounting section of the injection unit has a stepped shape and has an enlarged edge rested on a top of the mounting tube and a reduced edge secured in the mounting tube.

10. The mist sprayer in accordance with claim 8, wherein the cover of the injection unit has a periphery formed with a plurality of locking slots equally spaced from each other, and pressure storage member is mounted in the cover of the injection unit and has a top having a periphery formed with a plurality of locking blocks each locked in a respective one of the locking slots of the cover.

11. The mist sprayer in accordance with claim 10, wherein the mounting section of the injection unit has a periphery formed with a plurality of slits equally spaced from each other, so that the mounting section of the injection unit is flexible, and the locking blocks of the pressure storage member are inserted into the locking slots of the cover by flexibility of the mounting section provided by the slits.

12. The mist sprayer in accordance with claim 11, wherein each of the slits of the mounting section is extended into the cover of the injection unit.

13. The mist sprayer in accordance with claim 10, further comprising an O-ring mounted between an inner wall of the cover of the injection unit and the top of the pressure storage member.

14. The mist sprayer in accordance with claim 9, further comprising a decorative shade mounted between the mounting tube and the injection unit and having a top having an inner edge formed with a mounting flange mounted on the enlarged edge of the mounting section and rested on the top of the mounting tube.

15. The mist sprayer in accordance with claim 8, wherein the mounting seat is mounted on the nozzle of the injection unit and has a tapered upper portion mounted on the tapered head of the nozzle, the tapered upper portion of the mounting seat is formed with an aperture communicating with the nozzle of the injection unit, the mounting seat has an inner wall formed with a plurality of guide channels each communicating with the aperture and each having a gradually reduced distal end, and the inside of the bottle is communicating with the guide channels of the mounting seat.

16. The mist sprayer in accordance with claim 15, wherein the guide unit has a bottom formed with a conical striking face facing the aperture of the mounting seat and a top formed with a pointed guide face.

17. The mist sprayer in accordance with claim 1, wherein the mounting seat has a periphery formed with a plurality of mounting holes, and the guide unit has a periphery formed with a plurality of inserts each inserted into a respective one of the mounting holes of the mounting seat.

18. The mist sprayer in accordance with claim 8, wherein the lower end of the bottle is formed with a mounting portion mounted on the nozzle of the injection unit.

19. The mist sprayer in accordance with claim 8, wherein the injection unit further includes a plurality of sealing rings mounted on the nozzle and sealed between the nozzle of the injection unit and the bottle.

20. The mist sprayer in accordance with claim 1, further comprising a plug mounted on an upper end of the bottle and having an inside formed with a horn-shaped through hole communicating with the bottle.

* * * * *